United States Patent [19]

D'Luhy

[11] 4,039,046

[45] Aug. 2, 1977

[54] STUBLESS MULTI-PLY ASSEMBLY

[75] Inventor: Emil A. D'Luhy, Youngstown, N.Y.

[73] Assignee: Moore Business Forms, Inc., Niagara Falls, N.Y.

[21] Appl. No.: 623,393

[22] Filed: Oct. 17, 1975

[51] Int. Cl.[2] ..... B41L 1/24

[52] U.S. Cl. ..... 282/22 R; 281/21 R; 282/24 R; 282/11.5 R

[58] Field of Search ..... 282/22 R, 22 A, 23 R, 282/23 A, 24 R, 24 A, 24 B, 24 C, 11.5 R, 11.5 A; 281/21 R

[56] References Cited

U.S. PATENT DOCUMENTS

| | | | |
|---|---|---|---|
| 1,949,625 | 3/1934 | Ritzhaupt | 282/22 R |
| 1,980,319 | 11/1934 | Caton | 282/22 A |
| 2,006,034 | 6/1935 | Stevens | 282/22 R |
| 2,089,328 | 8/1937 | Bass | 282/22 R |
| 2,105,448 | 1/1938 | Brenn | 282/11.5 R |
| 2,226,722 | 12/1940 | Jones | 282/22 R |
| 2,226,765 | 12/1940 | Goodell | 281/21 R X |
| 2,557,875 | 6/1951 | Kerr | 281/22 R |

*Primary Examiner*—Jerome Schnall

*Attorney, Agent, or Firm*—Watson, Cole, Grindle & Watson

[57] ABSTRACT

A unit set or assembly of multiple plies includes superimposed top, intermediate and bottom plies as well as a cover ply disposed over the top ply. A flap is removably connected to this cover ply along the line of weakening and underlies the bottom ply. First and second axially aligned holes of different sizes are respectively provided in the bottom and intermediate plies, the size of the bottom ply holes being less than the size of the intermediate ply holes. Adhesive is provided on the flap for securing the top ply thereto, such adhesive extending through the intermediate ply holes. The size difference between the axially aligned holes defines portions of the bottom ply which serve to mask the intermediate ply holes so as to confine the cross-sectional size of the adhesive, which extends therethrough, to the smaller size of the bottom ply holes. Accordingly, the cover ply may be removed from the set while leaving the remaining plies intact, and separation of the top and bottom plies breaks the adhesive and frees the intermediate ply. Thus, a multi-ply set is provided without the need for a removable stub thereby resulting in paper savings and avoiding the need for stub handling and disposal.

3 Claims, 3 Drawing Figures

2
15
15
18
18
15
18
17
10
18
19
16
14
11
12
13
2

10

11
12
13
14
22
16a
15
18
16
17

22
17
16
11
12
15
13
18
19
14
10

STUBLESS MULTI-PLY ASSEMBLY

BACKGROUND OF THE INVENTION

Business forms arranged as interconnected unitary sets of multiple sheets or plies are available in various forms constructions and adapted for inscription either manually or with the use of a typewriter. The most common of these unit sets is one having a removable stub portion for interconnecting the sheets of the set together. The sheets may therefore be separated as the stub is removed, or individual sheets may be removed from the stub while leaving the remaining sheets of the set intact. Typically, such a set comprises a top record ply which is removed from the set for record keeping while the balance of the plies remain intact after which they are subsequently separated. This stub however represents a completely unusable portion of the form since it is ultimately discarded after removal. Any writing or printing on the form sheets must therefore be confined to areas outside the stub thereby resulting either in the need for larger sheets or a smaller printing and writing area. Hence, this wasteful stub accounts for a poor economical use of the set. Moreover, the sheets of the assembly are normally interconnected at the stub by glue lines axially aligned between the top and bottom sheets thereby adding to the thickness or bulk of the assembly.

U.S. Pat. No. 1,949,625 to Ritzhaupt discloses a forms construction which minimizes the thickness of the assembly at the forward end by means of attaching the sheets together by a single line of adhesive passing through axially aligned apertures provided in several of the sheets. However, a removable stub is nevertheless required for such assembly since it is so constructed that the sheets cannot be removed unless separated along the stub. All the drawbacks noted for the typical forms construction requiring a removable stub are therefore common to this prior art construction.

SUMMARY AND OBJECTS OF THE INVENTION

It is therefore an object of the present invention to provide a multi-ply unit set as having no stub portion yet thereby avoiding the noted disadvantages of an assembly requiring such stub while at the same time retaining the advantages of a stub.

Another object of the invention is to provide such a unit set of a stubless construction which is not only highly economical in its use since it avoids stub handling and disposal and permits a more effective use of the plies themselves, but is also simple in its construction and easy to manufacture.

In carrying out these objectives the multi-ply set of the invention comprises a four-ply construction including cover, top, intermediate and bottom plies. The cover ply is removably attached to a flap underlying the bottom ply and having adhesive provided thereon. Holes are provided in the bottom ply axially aligned with holes provided in the intermediate ply but of a size less than such intermediate ply holes. The adhesive on the flap extending through these aligned holes and engaging only the edges of the bottom ply holes. The difference in hole size defines portions of the bottom ply which serve to mask the intermediate ply holes and therefore confine the adhesive extending therethrough to a size equal to that of the bottom ply holes. The adhesive extending through the intermediate ply holes are therefore spaced inwardly of the hole margins thereof, thereby forming a four-ply construction wherein the cover ply may be separated while leaving the remaining plies intact, and the intermediate ply may be simply freed from the set as the adhesive is broken upon separation of the top and bottom plies.

DESCRIPTION OF THE PREFERRED EMBODIMENT

Figure 1:
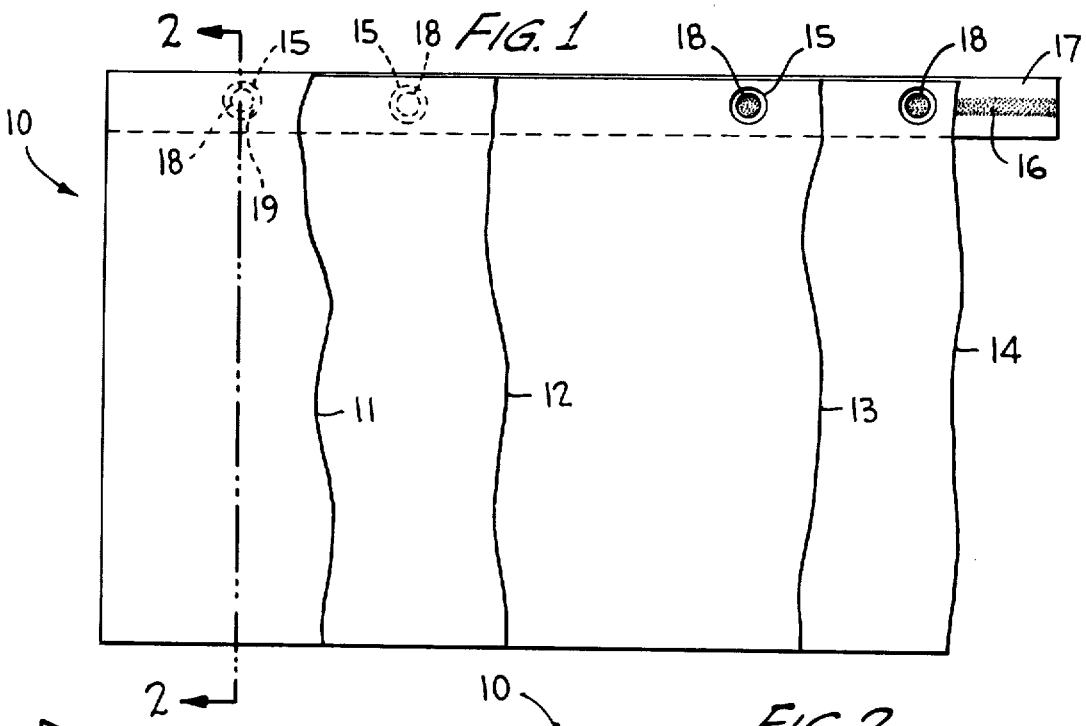
FIG. 1 is a top plan view of the multi-ply set according to the invention, several of the plies being broken away for clarity.
Figure 2:
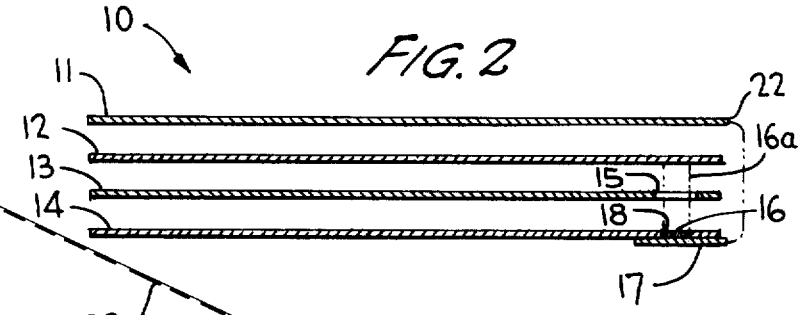
FIG. 2 is a cross-sectional view of the set taken substantially along line 2—2 of FIG. 1.
Figure 3:
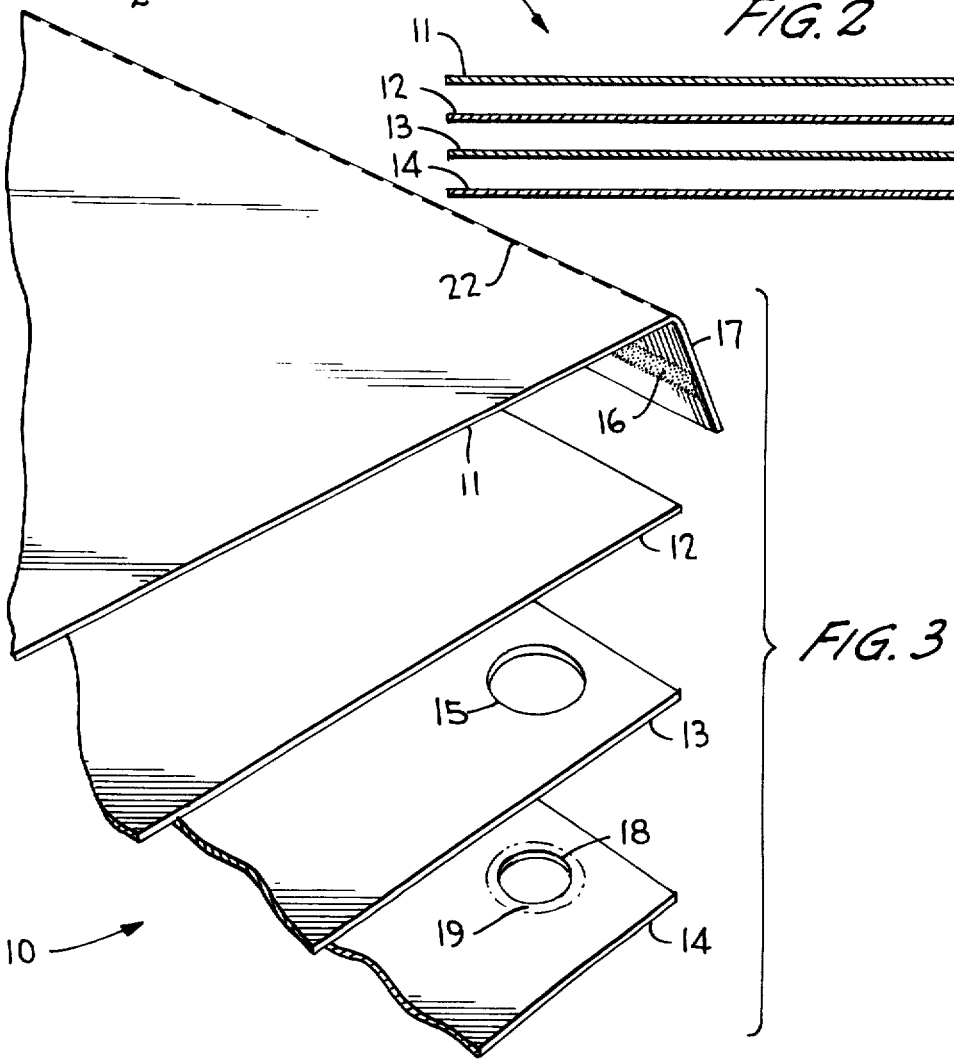
FIG. 3 is an expanded view of a portion of the multi-ply set, slightly enlarged, showing the details of the invention.

The unit set or assembly of multi-plies in accordance with the invention is generally designated 10 in the drawings and comprises essentially four superimposed plies—cover or top ply 11, upper or first intermediate ply 12, second intermediate ply 13 and lower ply 14. Holes 15 are provided along a marginal edge of intermediate ply 13, and adhesive 16 is provided on a flap 17 of the cover ply which underlies bottom ply 14. Holes 18 are provided in the bottom ply in axial alignment with holes 15, respectively. Adhesive 16 may be applied to flap 17 along a line as shown in FIG. 1, or dots of adhesive slightly greater than the size of holes 18 may be applied along the flap to coincide with the holes. Portions **16*a* of the line of adhesive 16 extend between ply 12 and flap 17, and these portions 16*a* extend through aligned openings 15 and 18 as clearly illustrated in FIG. 2. Such adhesive portions therefore secure upper ply 12 to the bottom ply as portions 16*a* completely fill holes 18 in the bottom ply. However, the difference in sizes between holes 15 and 18 define portions 19 of the bottom ply which serve to mask a part of holes 15. Accordingly, the size of portions 16*a* of adhesive extending through openings 15 of intermediate ply 13 are confined to the size of holes 18 in the bottom ply. And, since the holes in intermediate ply 13 and in the bottom ply are axially aligned, portions 16*a* of adhesive extending through holes 15 are located inwardly of the marginal edges of these holes as clearly shown in FIG. 2. Hence, no direct or positive adhesive securement is effected between the adhesive and intermediate ply 13. It is therefore seen that separation of the top and bottom plies 11 and 14 will effect a break of adhesive portions 16*a* thereby freeing intermediate ply 13** from the set.

Cover ply 11 overlies upper ply 12 and is removably attached to flap 17 along a line 22 of weakening. Flap 17 extends about the aligned marginal edges of plies 12, 13 and 14 as shown in exaggerated form in FIG. 2.

From the foregoing it can be seen that the unit set or assembly of multiple plies constructed in accordance with the invention is stubless so that indicia is capable of being applied to a larger area of each ply within the margins thereof as compared to a unit set having a stub. The cover or top ply 11 is removable from the set along line 22 of weakening without affecting the balance of the set. That is, the cover ply may be separated from the set without breaking the adhesive so that plies 12, 13 and 14 of the set remain intact. However, by separating plies 12 and 14 to cause a break in adhesive portions **16*a*, intermediate ply 13 is simply freed from the set since it was never adhesively secured in place. Of course, the provision of additional intermediate plies is possible for this construction so long as each is provided with holes such as 15 of greater size as compared to axially aligned holes 18 in the bottom ply. And, carbon transfer material or some type of known carbonless transfer composition or a mixture of carbon transfer and carbonless transfer materials may be coated on the undersides of plies 11, 12 and 13** so as to transfer indicia applied to the cover ply through the set and on to the bottom ply.

In addition to those advantages mentioned above concerning the greater areas on each ply made available for applying information, the stubless form in accordance with the invention avoids the need for handling any stub or further disposing of same. Stub waste is therefore avoided and greater economical use is made available for the form.

Obviously, many other modifications and variations of the invention are made possible in the light of the above teachings. It is therefore to be understood that within the scope of the appended claims the invention may be practiced otherwise than as specifically described.

What is claimed is:

1. A unit set of multiple plies, comprising at least superimposed first, second, third and fourth plies, said first ply having a folded flap removably connected along one edge of said top ply by a line of weakening extending along the fold between said flap and said top ply, said third ply having at least one first hole of a predetermined first size lying adjacent one edge thereof, said flap underlying said fourth ply and having a quantity of detachable adhesive thereon securing said first ply to said fourth ply, said fourth ply having at least one second hole of a predetermined second size lying adjacent one edge thereof in axial alignment with said first hole, the size of said second hole being less than the size of said first hole, a portion of said quantity of adhesive extending through said first and second holes and securing said second and fourth plies together along one edge of said second ply, said quantity of adhesive lying inwardly of said first hole by reason of the difference in size between said holes to thereby immobilize said third ply in place, said edges of each said plies lying at a common end of said unit set, and said plies each being devoid of any tear lines which may form a stub, whereby removal of said first ply along said line of weakening leaves said second, third and fourth plies intact, or separation of said second and fourth plies effects a break of said adhesive and frees said third ply from the set while leaving said first and fourth plies interconnected, or removal of said first ply together with separation of said second and fourth plies separates each of said plies from one another.

2. The unit set according to claim 1, wherein said first, second, third and fourth plies respectively comprise top, first intermediate, second intermediate and bottom plies.

3. The unit set according to claim 1, wherein a plurality of said aligned first and second holes are provided in said third and fourth plies, respectively.

* * * * *